US011464391B2

(12) United States Patent
Haegermarck et al.

(10) Patent No.: US 11,464,391 B2
(45) Date of Patent: Oct. 11, 2022

(54) SPRAY ARM ASSEMBLY

(71) Applicant: ELECTROLUX APPLIANCES AKTIEBOLAG, Stockholm (SE)

(72) Inventors: Anders Haegermarck, Trångsund (SE); Marie Hakkarainen, Stockholm (SE); Elianne Lindmark, Stockholm (SE)

(73) Assignee: Electrolux Appliances Aktiebolag

( * ) Notice: Subject to any disclaimer, the term of this patent is extended or adjusted under 35 U.S.C. 154(b) by 266 days.

(21) Appl. No.: 16/755,224

(22) PCT Filed: Oct. 31, 2017

(86) PCT No.: PCT/EP2017/077874
§ 371 (c)(1),
(2) Date: Apr. 10, 2020

(87) PCT Pub. No.: WO2019/086106
PCT Pub. Date: May 9, 2019

(65) Prior Publication Data
US 2020/0245840 A1 Aug. 6, 2020

(51) Int. Cl.
*A47L 15/42* (2006.01)
*A47L 15/23* (2006.01)
*A47L 15/50* (2006.01)

(52) U.S. Cl.
CPC ..... *A47L 15/4221* (2013.01); *A47L 15/23* (2013.01); *A47L 15/4282* (2013.01); (Continued)

(58) Field of Classification Search
CPC .. A47L 15/4221; A47L 15/23; A47L 15/4282; A47L 15/507; A47L 15/508; A47L 2401/24; A47L 2501/20
See application file for complete search history.

(56) References Cited

U.S. PATENT DOCUMENTS 1,408,077 A 2/1922 Clinton
2,013,387 A 9/1935 Johnston
(Continued)

FOREIGN PATENT DOCUMENTS

AT 251239 B 12/1966
CH 406549 A 1/1966
(Continued)

OTHER PUBLICATIONS

International Search Report and Written Opinion for Application No. PCT/EP2017/077874 dated Jan. 18, 2018, 10 pages.

*Primary Examiner* — Michael E Barr
*Assistant Examiner* — Pallavi Chitta
(74) *Attorney, Agent, or Firm* — RatnerPrestia

(57) ABSTRACT

Provided herein are a spray arm assembly and associated dishwasher. The spray arm assembly may include a spray arm and a satellite arm. The spray arm may have a body defining an inlet opening and an outlet opening spaced along the body, and the body may receive washing fluid at the inlet opening and direct at least a portion of the washing fluid to an outlet opening. The body may further define one or more fluid supply channels extending between and fluidly communicating the inlet opening and the outlet opening. The satellite arm may be rotatably coupled to the spray arm at the outlet opening, and a portion of the one or more fluid supply channels may extend past the outlet opening to direct at least a portion of the washing fluid past the outlet opening and back towards the inlet opening before entering the outlet opening.

15 Claims, 11 Drawing Sheets

(52) U.S. Cl.
CPC ..... *A47L 15/507* (2013.01); *A47L 15/508* (2013.01); *A47L 2401/24* (2013.01); *A47L 2501/20* (2013.01)

(56) References Cited

U.S. PATENT DOCUMENTS

| | | | |
|---|---|---|---|
| 2,637,595 | A | 5/1953 | Fox et al. |
| 3,267,944 | A | 8/1966 | Meeker et al. |
| 3,342,421 | A | 9/1967 | Schutte |
| 3,362,645 | A | 1/1968 | Clark |
| 3,468,485 | A | 9/1969 | Sully |
| 3,677,473 | A | 7/1972 | Belaieff |
| 3,771,725 | A | 11/1973 | Jenkins et al. |
| 3,918,644 | A | 11/1975 | Platt et al. |
| 4,064,887 | A | 12/1977 | Geiger et al. |
| 4,210,285 | A | 7/1980 | Dicken et al. |
| 4,266,565 | A | 5/1981 | Gurubatham |
| 4,301,822 | A | 11/1981 | Dingler |
| 4,869,428 | A | 9/1989 | Gombar |
| 5,211,190 | A | 5/1993 | Johnson et al. |
| 5,268,153 | A | 12/1993 | Muller |
| 5,433,228 | A | 7/1995 | Dingler |
| 5,477,874 | A | 12/1995 | Yura et al. |
| 5,542,443 | A | 8/1996 | Yura et al. |
| 5,598,976 | A | 2/1997 | Jang et al. |
| 5,609,174 | A | 3/1997 | Ferguson |
| 5,623,956 | A | 4/1997 | Kirkland |
| 5,662,744 | A | 9/1997 | Tuller et al. |
| 5,673,716 | A | 10/1997 | Gurubatham et al. |
| 5,752,533 | A | 5/1998 | Edwards |
| 5,904,166 | A | 5/1999 | Nannt et al. |
| 6,357,460 | B1 | 3/2002 | Bertsch et al. |
| D461,284 | S | 8/2002 | Hegeman et al. |
| 6,662,814 | B2 | 12/2003 | Tobbe et al. |
| 6,959,881 | B2 | 11/2005 | Kim |
| 7,237,563 | B2 | 7/2007 | Han et al. |
| 7,753,062 | B2 | 7/2010 | Burrows et al. |
| 7,931,034 | B2 | 4/2011 | Mack et al. |
| 7,988,791 | B2 | 8/2011 | Delgado |
| 8,020,468 | B2 | 9/2011 | Yang |
| 8,020,568 | B2 | 9/2011 | Pyo et al. |
| 8,211,243 | B2 | 7/2012 | Delgado |
| 8,287,660 | B2 | 10/2012 | Chen et al. |
| 8,333,207 | B2 | 12/2012 | Calhoun et al. |
| D675,387 | S | 1/2013 | Burrows et al. |
| 8,807,150 | B2 | 8/2014 | Boyer et al. |
| 8,858,729 | B2 | 10/2014 | Buddharaju et al. |
| 8,939,162 | B2 | 1/2015 | Winkler et al. |
| 8,985,126 | B2 | 3/2015 | Forster et al. |
| 9,010,345 | B2 | 4/2015 | Mitchell et al. |
| 9,314,144 | B2 | 4/2016 | Bayer et al. |
| 9,427,132 | B2 | 4/2016 | Boyer et al. |
| 9,456,730 | B2 | 10/2016 | Bayer et al. |
| 9,462,924 | B2 | 10/2016 | Pyo et al. |
| 9,462,925 | B2 | 10/2016 | Boyer et al. |
| 9,462,927 | B2 | 10/2016 | Lee et al. |
| 9,516,988 | B2 | 12/2016 | Zhao et al. |
| 10,582,827 | B2 | 3/2020 | Yoo et al. |
| 10,682,037 | B2 | 6/2020 | Feddema et al. |
| 10,743,740 | B2 | 8/2020 | Feddema et al. |
| 10,952,589 | B2 | 3/2021 | Brightbill et al. |
| 10,959,596 | B2 | 3/2021 | Feddema et al. |
| 11,219,349 | B2 | 1/2022 | Haegermarck |
| 2005/0045672 | A1 | 3/2005 | Marone |
| 2005/0224098 | A1 | 10/2005 | Fujii et al. |
| 2005/0230502 | A1 | 10/2005 | Bragg et al. |
| 2005/0241681 | A1 | 11/2005 | Hwang |
| 2006/0054204 | A1 | 3/2006 | Fischer |
| 2009/0145468 | A1 | 6/2009 | Chericoni |
| 2009/0255560 | A1 | 10/2009 | Lehmann et al. |
| 2010/0012158 | A1 | 1/2010 | Rosenbauer et al. |
| 2010/0065091 | A1 | 3/2010 | Hartmann et al. |
| 2011/0174345 | A1 | 7/2011 | Carrer et al. |
| 2011/0203619 | A1 | 8/2011 | Kara et al. |
| 2012/0037193 | A1 | 2/2012 | Bayer et al. |
| 2012/0279534 | A1 | 11/2012 | Boyer et al. |
| 2012/0279536 | A1 | 11/2012 | Adams et al. |
| 2012/0305037 | A1 | 12/2012 | Petric et al. |
| 2013/0125936 | A1 | 5/2013 | Forster et al. |
| 2013/0206179 | A1 | 8/2013 | Watson et al. |
| 2013/0284216 | A1 | 10/2013 | Forster et al. |
| 2014/0102492 | A1 | 4/2014 | Kim et al. |
| 2014/0190534 | A1 | 7/2014 | Boyer |
| 2014/0345654 | A1 | 11/2014 | Cho et al. |
| 2015/0020855 | A1 | 1/2015 | Lundberg et al. |
| 2016/0015241 | A1 | 1/2016 | Han et al. |
| 2016/0192818 | A1 | 7/2016 | Gursoy et al. |
| 2016/0220090 | A1 | 8/2016 | Woo et al. |
| 2016/0324392 | A1 | 11/2016 | Xu et al. |
| 2016/0324393 | A1 | 11/2016 | Xu et al. |
| 2017/0354308 | A1 | 12/2017 | Choi et al. |
| 2017/0354311 | A1 | 12/2017 | Yoo et al. |
| 2017/0354312 | A1 | 12/2017 | Woo et al. |
| 2018/0271348 | A1 | 9/2018 | Li |
| 2020/0323415 | A1 | 10/2020 | Feddema et al. |

FOREIGN PATENT DOCUMENTS

| | | | | |
|---|---|---|---|---|
| CH | 564937 | A | | 8/1975 |
| CN | 201312795 | Y | | 9/2009 |
| CN | 201333016 | Y | | 10/2009 |
| CN | 101677743 | A | | 3/2010 |
| CN | 102170816 | A | | 8/2011 |
| CN | 102469907 | A | | 5/2012 |
| CN | 102905602 | A | | 1/2013 |
| CN | 203789866 | U | | 8/2014 |
| CN | 104271024 | A | | 1/2015 |
| CN | 104284620 | A | | 1/2015 |
| CN | 205268092 | U | | 6/2016 |
| DE | 7122831 | U | | 9/1971 |
| DE | 3428439 | A1 | | 2/1986 |
| DE | 8516941 | U1 | | 10/1986 |
| DE | 3702828 | C1 | | 4/1988 |
| DE | 4004319 | A1 | | 8/1991 |
| DE | 9114093 | U1 | | 3/1993 |
| DE | 9211182 | U1 | | 12/1993 |
| DE | 19736919 | A1 | | 3/1999 |
| DE | 19812329 | C1 | | 6/1999 |
| DE | 198 41 355 | A1 | | 3/2000 |
| DE | 20014038 | U1 | | 12/2000 |
| DE | 29921565 | U1 | | 4/2001 |
| DE | 20113227 | U1 | | 10/2001 |
| DE | 102010043021 | A1 | | 5/2012 |
| DE | 102011088494 | A1 | | 6/2013 |
| DE | 102015207588 | A1 | | 10/2016 |
| EP | 0335791 | A1 | | 10/1989 |
| EP | 0389852 | A2 | | 10/1990 |
| EP | 0772994 | A1 | | 5/1997 |
| EP | 1238622 | A2 | | 9/2002 |
| EP | 1767134 | A2 | | 3/2007 |
| EP | 2050480 | A1 | | 4/2009 |
| EP | 2067428 | A2 | | 6/2009 |
| EP | 2 215 952 | A1 | | 8/2010 |
| EP | 2240065 | A1 | | 10/2010 |
| EP | 2 192 852 | B1 | | 9/2011 |
| EP | 2389851 | A1 | | 11/2011 |
| EP | 2 441 369 | A2 | | 4/2012 |
| EP | 2 446 799 | A2 | | 5/2012 |
| EP | 2494906 | A1 | | 9/2012 |
| EP | 2556781 | A1 | | 2/2013 |
| EP | 2721989 | A1 | | 4/2014 |
| EP | 3050480 | A1 | | 8/2016 |
| EP | 3085293 | A1 | | 10/2016 |
| GB | 1462398 | | | 1/1977 |
| IT | TO20030117 | U1 | | 1/2005 |
| JP | S50 140271 | U | | 11/1975 |
| JP | 04338438 | A | | 11/1992 |
| JP | 07163505 | A | | 6/1995 |
| JP | 07250799 | A | | 10/1995 |
| JP | H10 57295 | A | | 3/1998 |
| JP | H1057295 | A | * | 3/1998 |
| JP | 10127560 | A | | 5/1998 |
| JP | 2861792 | B2 | | 2/1999 |
| JP | 2006095001 | A | | 4/2006 |

(56) References Cited

FOREIGN PATENT DOCUMENTS

| | | | |
|---|---|---|---|
| JP | 2011 224232 | A | 11/2011 |
| JP | 2014004270 | A | 1/2014 |
| KR | 100457573 | B1 | 11/2004 |
| KR | 101054221 | B1 | 8/2011 |
| KR | 20120022429 | A | 3/2012 |
| KR | 20120078276 | A | 7/2012 |
| KR | 101598753 | B1 | 2/2016 |
| WO | 2006069827 | A1 | 7/2006 |
| WO | 2009021626 | A1 | 2/2009 |
| WO | 2009083576 | A1 | 7/2009 |
| WO | 2010089149 | A2 | 8/2010 |
| WO | 2011038189 | A1 | 3/2011 |
| WO | WO 2011/147716 | A1 | 12/2011 |
| WO | 2015149859 | A1 | 10/2015 |
| WO | WO 2015/144198 | A1 | 10/2015 |
| WO | WO 2018/006975 | A1 | 1/2018 |
| WO | WO 2018/006976 | A1 | 1/2018 |
| WO | 2019086107 | A1 | 5/2019 |

* cited by examiner

SPRAY ARM ASSEMBLY

CROSS-REFERENCE TO RELATED APPLICATIONS

This application is a national stage application filed under 35 U.S.C. § 371 of International Application No. PCT/EP2017/077874 filed Oct. 31, 2017, which application is hereby incorporated by reference in its entirety.

BACKGROUND

Field of the Invention

Embodiments of the present invention relate generally to dishwashers and, more particularly, to dishwashers, dishwasher spray arm arrangements, and associated spraying devices and fluid flow paths.

Description of Related Art

Dishwashers have become essential as everyday appliances in a majority of households and are relied upon to perform effective clean and wash cycles. Additionally, as environmental and cost of ownership concerns grow, dishwashers are increasingly expected to perform efficiently by reducing their use of power and water during operation. A dishwasher may employ a washing chamber or tub with various racks to support dishware during a washing cycle. Additionally, dishwashers may dispense washing fluid in order to clean the dishware within the dishwasher. However, traditional dishwasher spray arm configurations may not provide for sufficiently consistent and uniform flow for the washing fluid, resulting in reduced effectiveness of the cleaning cycle by distributing cleaning fluid having a reduced strength and wavering flow.

There is a need for an effective wash arm arrangement for providing a steady, consistent flow of washing fluid in order to improve the efficiency and effectiveness of dishwasher wash cycles. Applicant has identified a number of other deficiencies and problems associated with conventional dishwashers, spray arms, and other associated systems and methods. Through applied effort, ingenuity, and innovation, many of these identified problems have been solved by developing solutions that are included in embodiments of the present invention, many examples of which are described in detail herein.

BRIEF SUMMARY

Embodiments discussed herein are generally directed to a spray arm assembly having improved fluid flow, efficiency, consistency, high dirt resistance with low risk of clogging, and low build height, and a corresponding dishwasher. As described herein, the spray arm assembly may include one or more flow-shaping structures that control and direct washing fluid from a main spray arm into an attached satellite arm while ensuring consistent even spray from the satellite arm and consistent cleaning of the dishware in the dishwasher. The satellite arm assembly described herein requires a greater fluid flow than any individual spray outlet of a traditional dishwasher spray arm, and as such, the present disclosure includes improved fluid flow beyond a typical dishwasher spray arm.

In some embodiments, a spray arm assembly may be provided that includes a spray arm and a satellite arm. The spray arm may include a body defining an inlet opening and an outlet opening spaced along the body from each other. The body may be configured to receive washing fluid through the inlet opening and direct the washing fluid to the outlet opening. The body may further define one or more fluid supply channels extending between and fluidly communicating the inlet opening and the outlet opening within the body. The satellite arm may be rotatably coupled to the spray arm at the outlet opening. At least a portion of the one or more fluid supply channels extends past the outlet opening relative to the inlet opening such that the one or more fluid supply channels are configured to direct the washing fluid flowing from the inlet opening to the outlet opening radially past the outlet opening and at least partially back towards the inlet opening before entering the outlet opening and the satellite arm.

In some embodiments, the body of the spray arm may further define a curved inner surface located within the body at an end of the spray arm past the outlet opening relative the inlet opening. The curved inner surface may correspond the portion of the one or more fluid supply channels that extend past the outlet opening, such that the curved inner surface may be configured to redirect the washing fluid at least partially back towards the inlet opening. In some embodiments, the curved inner surface of the body may comprise two concave semi-circular walls. The two semi-circular walls may be positioned so as to form a convergence point between the two semi-circular walls, and the convergence point may be located substantially along an axis extending between the inlet opening and the outlet opening.

In some embodiments, the one or more fluid supply channels may be configured to redirect washing fluid flowing from the inlet opening to the outlet opening radially past the outlet opening at an angle greater than 90° from an initial direction. The initial direction may be defined parallel with an axis extending between the inlet opening and the outlet opening in a direction extending from the inlet opening to the outlet opening. In some embodiments, the angle may be greater than 90° and less than or equal to 180°.

In some embodiments, the body may further comprise a flow-directing element disposed between the inlet opening and the outlet opening. The flow-directing element may divide one of the one or more fluid supply channels into two fluid supply channels each located along opposing sides of flow-directing element to separate the washing fluid flowing through the spray arm. The flow-directing element may extend vertically from an interior bottom surface of the body to an interior top surface of the body. In some embodiments, the one or more fluid supply channels, including the two fluid supply channels, may be configured to at least partially direct the separated washing fluid laterally inwardly towards an axis extending between the inlet opening and the outlet opening. The flow-directing element may be located along an axis extending between the inlet opening and the outlet opening adjacent the outlet opening. The flow-directing element and the one or more fluid supply channels may be configured such that at least a portion of the washing fluid converges at the outlet opening from all sides.

In some embodiments, the body of the spray arm may further define a fluid control member disposed beneath the outlet opening configured to align washing fluid directed by the one or more fluid supply channels from the inlet opening to the outlet opening. The fluid control member defines a protrusion that extends from an interior bottom surface of the body toward the outlet opening. In some embodiments, the protrusion of the fluid control member defines a longitudinal axis that may be substantially coaxial with a longitudinal axis of a conduit of the satellite arm.

In another embodiment, a dishwasher may be provided that includes a rack and the spray arm assembly according to any of the embodiments described herein.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the invention or inventions are shown. Indeed, these inventions may be embodied in many different forms and should not be construed as limited to the embodiments set forth herein; rather, these embodiments are provided so that this disclosure will satisfy applicable legal requirements. The terms "illustrative" and "exemplary" are used to be examples with no indication of quality level. As used herein, the terms "approximately," "generally," and "substantially" refer to within manufacturing and/or engineering design tolerances for the corresponding materials and/or elements as would be understood by the person of ordinary skill in the art, unless otherwise indicated. As used herein, terms such as "front," "rear," "top," etc. are used for explanatory purposes in the examples provided below to describe the relative position of certain components or portions of components, and need not describe the absolute position of any component relative to the earth at all points in time. For example, one component being described as a "top" or "upper" component may be above a "bottom" or "lower" component in an operational position, but the "top" or "upper" component may be below another "lower" component elsewhere in the dishwasher or may be below the "lower" or "bottom" component during manufacturing, shipping, or installation. As used herein, terms such as "channel," "conduit," "fluid channel," and the like may be used interchangeable to encompass any structure through which a fluid may flow. In particular, any configuration of horizontal walls, vertical vanes, or any structure which directs, at least partially encloses, or supports fluid flow is contemplated by the aforementioned terms in embodiments of the present disclosure. Additionally, as used herein, each of "water," "liquid," "fluid," "wash fluid," "rinse water," "cleaning fluid," "washing fluid," and the like refers to any liquid or fluid used in dishwashers and associated wash arm arrangements and spray arm assemblies. Like numbers refer to like elements throughout.

Figure 1:
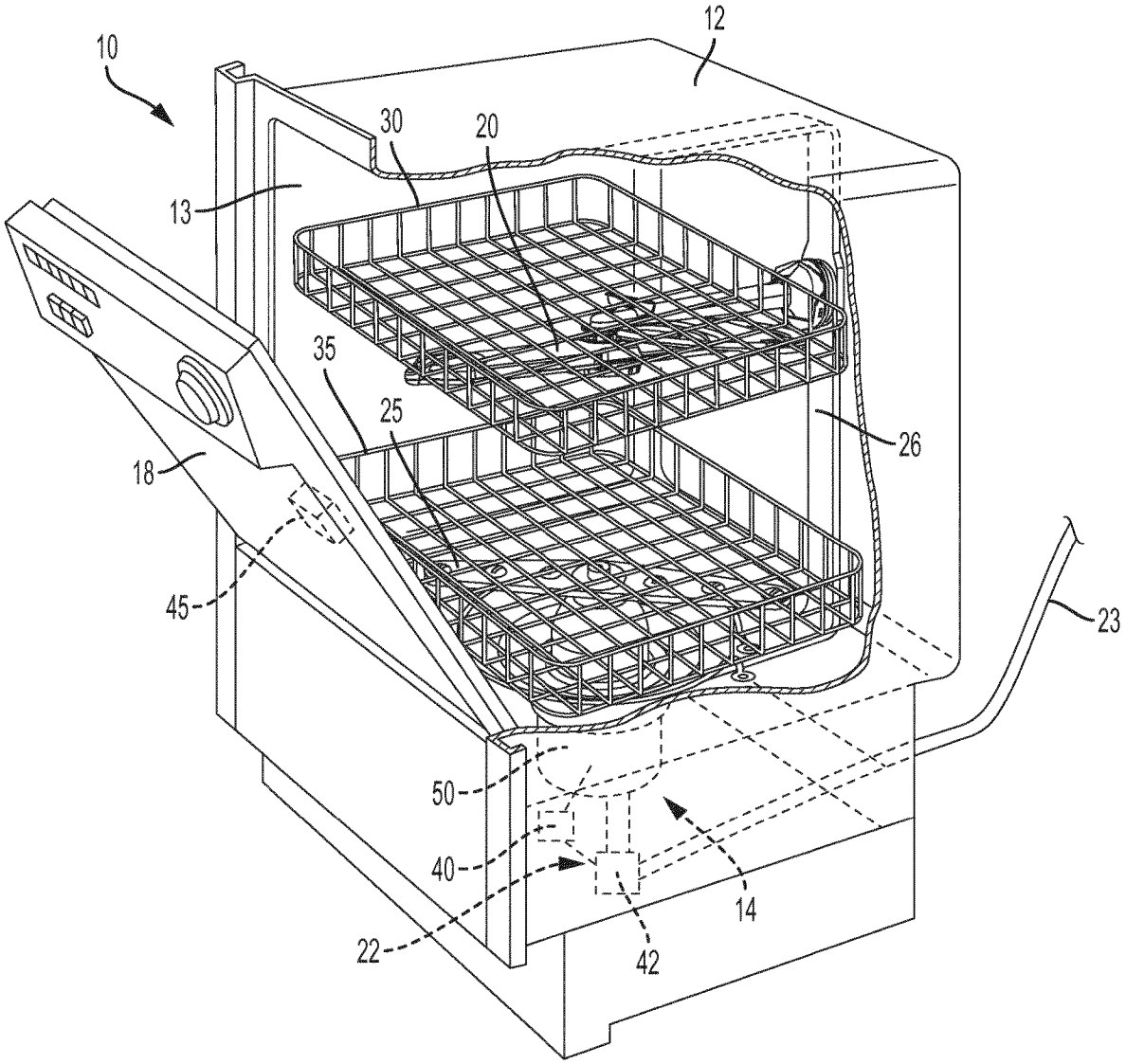
FIG. 1 illustrates a perspective, partial cut-away view of a dishwasher of a type suitable for use with various embodiments described herein.

With reference to FIG. 1, an example of a dishwasher 10 capable of implementing various embodiments of the present invention is illustrated. The depicted dishwasher 10 includes a tub 12 (partially cut-away to illustrate internal elements), having a plurality of walls (e.g., side walls 13) that form an enclosure or washing chamber in which dishes, utensils, and other dishware may be placed for washing. The dishwasher 10 may also include a door 18 pivotably engaged (e.g., via a hinge) with the tub 12 to selectively permit access to the interior of the tub 12. For example, the door 18 may operate to allow for an open configuration in which items housed by the dishwasher 10 may be removed and/or added, and a closed configuration in which the dishwasher 10 may be operational (e.g., allowed to perform a cleaning/washing cycle or the like). Furthermore, the door 18 may at least substantially seal a forward access opening of the tub 12 in the closed configuration such that washing fluid used by the dishwasher 10 is contained within the tub 12.

The door 18 of the dishwasher 10 may comprise an inner surface that acts as a wall of the tub 12 when the door 18 is in the closed configuration. In some embodiments, a detergent dispenser 45 may be disposed on and/or embedded in the inner surface of the door 18. A user of the dishwasher 10 may provide detergent into the detergent dispenser 45 before starting a dishwashing program such that the detergent may be provided to the washing fluid within the tub 12 during a pre-wash and/or wash cycle of a dishwashing program. In an example embodiment, the detergent dispenser 45 comprises a hinged door that the user closes before starting the dishwashing program and said hinged door is electro-mechanically openable during a wash cycle of the dishwashing program by a controller 40 or the like.

The tub 12 may include a sump 14 in which washing fluid is collected, typically under the influence of gravity. The washing fluid may be pumped by a circulation pump 50 to one or more spray arm assemblies 20, 25 mounted in the interior of the tub 12 for spraying the washing fluid or rinse water, under pressure, onto the dishware contained therein. In some embodiments, a spray arm assembly 20 may be mounted to a middle or lower rack (e.g., dish racks 30, 35) or mounted to a wall 13 of the tub 12. By way of example, the circulation pump 50 may be configured to pump washing fluid through a circulation conduit 26 to a spray arm assembly 20 for spraying into the tub 12, such as through one or more spray nozzles located on a spray arm 21 (labelled in FIG. 2). While illustrated and described in reference to a spray arm assembly 20 (e.g., including spray arm 21 and satellite arm 285 shown in FIG. 2) located along the middle of the tub 12, the present disclosure contemplates positioning one or more spray arm assemblies within the tub 12 to spray washing fluid onto any rack or basket therein. For example, in some embodiments, the dishwasher 10 may also include an upper spray arm (not shown) disposed proximate the top wall of the tub 12 and configured to spray downwardly towards an upper rack and/or a middle rack.

The dishwasher 10 may also comprise a controller 40 that may be in communication with one or more of the operational components of the dishwasher 10. For example, the controller 40 may be in communication with the circulation pump 50 and may be configured to selectively operate the circulation pump 50 to pump washing fluid to at least one spray arm and/or spray nozzle. In some embodiments, the controller 40 may be in communication with the detergent dispenser to release the detergent at a predetermined time during a dishwasher program cycle. In another example, the controller 40 may be in communication with a water inflow system (not shown) configured to provide water to the dishwasher 10. In various embodiments, the controller 40 may be in communication with a drain pump 42 configured to pump washing fluid out of the dishwasher 10 via drain pipe 23.

In some embodiments, the controller 40 may comprise a processor and/or other computing means such that operations can be performed in the dishwasher. Additionally or alternatively, the controller 40 may comprise a memory (e.g., volatile memory and/or nonvolatile memory) for storage of data and/or executable instructions such as routines for operation of the dishwasher. In some embodiments, the controller 40 may further comprise a communications interface for communicating with various elements of the dishwasher 10 (e.g., the circulation pump 50, a door sensor, a user interface sensor, and/or the like) or for communicating with one or more computing devices via a wired or wireless network (e.g., the Internet, a local Wi-Fi network, and/or the like). In some embodiments, the controller 40 may comprise a mechanical timer in addition to or in place of a processor. In some embodiments, the controller 40 may be housed in the lower end 22 of the dishwasher 10 beneath the tub 12.

The dishwasher 10 may also include at least one dish rack 30, 35 for holding or otherwise supporting dishware. The dish rack 30, 35 may be positioned within the tub 12 to hold dishware for cleaning, such as through washing fluid that is sprayed onto the dishware from the spray arms and/or spray nozzles of one or more spray arm assemblies 20, 25. For example, in one example embodiment, a spray arm assembly 20 may be secured to the underside of an upper or middle rack 30.

Figure 2:
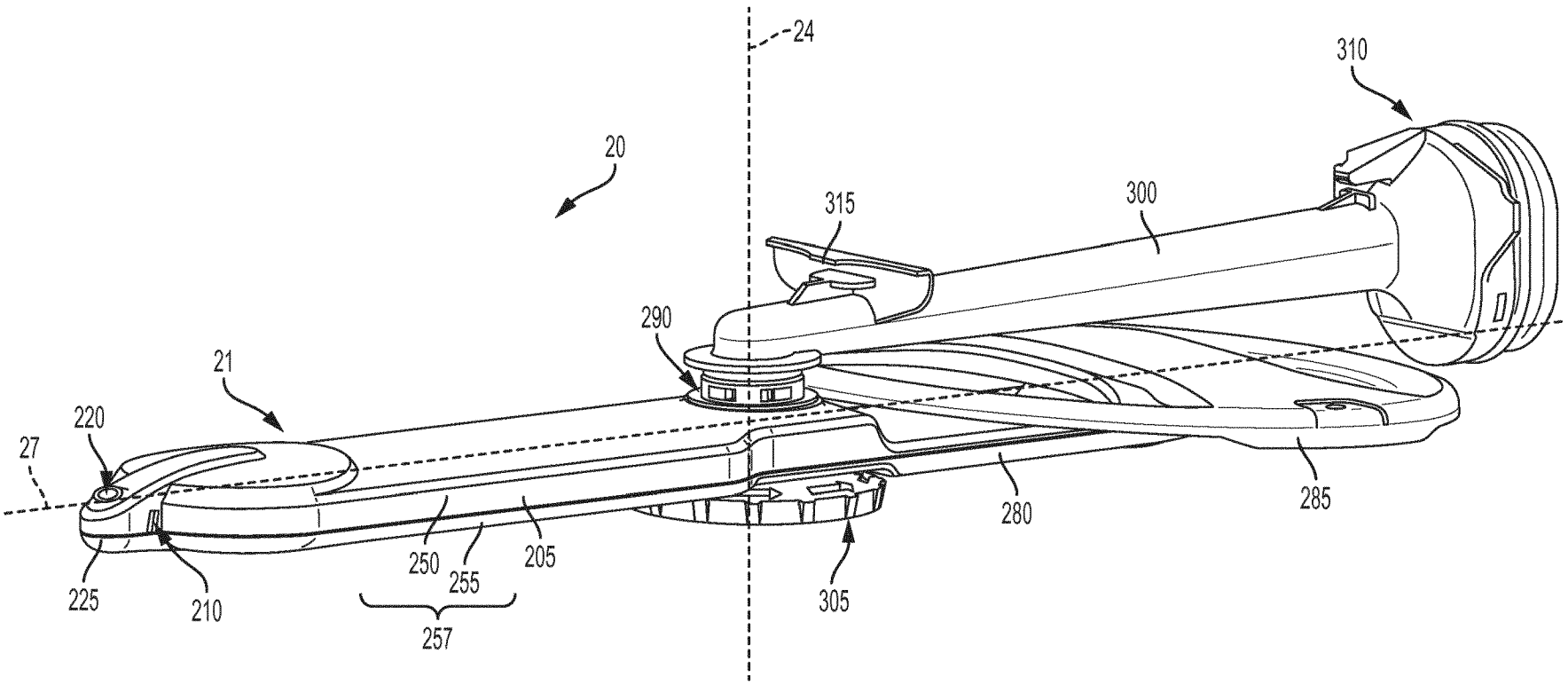
FIG. 2 illustrates a perspective view of a spray arm assembly, having a spray arm in accordance with an example embodiment.

In the example embodiment of FIG. 2, the spray arm 21 is rotatably coupled and/or attached to the fluid conduit 300 and includes a satellite arm 285 rotatably coupled thereto. In some embodiments, the fluid conduit 300 may be coupled and/or attached to a corresponding dish rack 30. For example, the fluid conduit 300 may be coupled to a height adjustable dish rack 30 and may move when the dish rack 30 is adjusted between a first position and/or height and a second position and/or height. In the example embodiment of FIG. 2, the fluid conduit 300 also includes a flexible coupling 310 on an end of the fluid conduit 300 that is opposite the spray arm assembly 20 that is configured to engage the water circulation conduit 26 at various heights and/or positions.

Embodiments of the present invention generally relate to a spray arm assembly 20 including a spray arm (e.g., spray arm 21 in FIG. 2) that uses one or more fluid supply channels (e.g., fluid supply channels 281, 283, 284 in FIGS. 3B, 4A, and 5-9) to direct washing fluid to a satellite arm assembly 285. In some embodiments, the body 257 (e.g., the combined top shell 250 and bottom shell 255 shown in FIG. 2) of the spray arm 21 may include an inlet opening and an outlet opening spaced along the body 257. The body 257 of the spray arm 21 may also be configured such that one or more fluid supply channels direct and fluidly communicate the inlet and outlet opening such that washing fluid may flow from the inlet opening to the outlet opening. In particular, the one or more fluid supply channels may be configured such that a portion of the washing fluid flowing from the inlet opening is directed (via a portion of the one or more fluid supply channels) radially past the outlet opening and at least partially back towards the inlet opening before entering the outlet opening. Example embodiments of the present disclosure therefore provide multiple advantages. In particular, the one or more fluid supply channels may direct a laminar flow of fluid into the outlet opening from all sides, including from behind the outlet opening, to maximize the throughput and flow consistency at the outlet and into the satellite arm assembly 285 above. In addition, the portion of the one or more fluid supply channels that extends past the outlet opening may be configured such that the wash fluid within the body 257 is redirected to all sides of the inlet of the satellite arm 285 to ensure that a consistent, steady fluid flow is received by the outlet opening.

By providing a consistent, steady fluid flow of washing fluid within the spray arm, example embodiments provided herein provide for an improvement in the stream of washing fluid ultimately applied to the dishware within the dishwasher (either directly via nozzles at the outlet opening or indirectly through one or more satellite assemblies discussed hereinafter) resulting in a more effective wash cycle. Therefore, example embodiments of the dishwasher 10, spray arm 21, and/or fluid supply channels 281, 283, 284 (e.g., see FIGS. 3B, 4A, and 5-9) also provide the advantage of a more energy and water efficient use of the washing fluid provided to the outlet opening 282.

Example embodiments as shown in FIG. 2 provide for a spray arm assembly 20 having a spray arm 21 and a satellite arm 285. The body 257 of the spray arm 21 has a spray detergent nozzle 210 that emits a fan-shaped spray of water to drive the spray arm and/or a corner nozzle 220 to reach the edges of the dish rack 30, 35. In some embodiments, the spray arm 21 may be located at any height within the tub 12 of the dishwasher 10, and, in particular, may be positioned at a height that is closest to the height of the detergent dispenser 45. With reference to FIG. 2, a perspective view of an example spray arm 21 is illustrated where washing fluid is supplied to the spray arm 21 via water conduit 300 of the spray arm assembly 20. The water conduit 300 is configured to receive washing fluid from the water circulation conduit 26 and provide the washing fluid to the spray arm 21. When the circulation pump 50 is operated, the circulation pump 50 pumps the washing fluid through the water circulation conduit 26 to the water conduit 300. In the depicted embodiment, the spray arm 21 is rotatably mounted on, coupled to, attached to, and/or the like the water conduit 300 and the water conduit 300 is mounted to a height adjustable dish rack 30 via a mounting element 315. In some embodiments, the spray arm assembly 20 may be mounted to a wall 13 of the tub 12 in a height adjustable manner (e.g., via the water conduit 300). In some embodiments, the spray arm 21 may be movable vertically relative to the in-use orientation of the dishwasher 10.

In the embodiment shown in FIG. 2, the spray arm 21 is mounted to the water conduit 300 at an inlet opening 290. Generally, inlet opening 290 is configured to receive water from the water conduit 300 to one or more fluid supply channels located within and/or defined by the body 257 of the spray arm 21, and the spray arm 21 is configured to rotate about the inlet opening 290 by a coupling device (e.g., via a lock nut 305 in FIG. 2). In the example embodiment shown in FIG. 2, the spray arm 21 includes a driving side 205 and a satellite side 280. The spray arm 21 may further include a satellite arm assembly 285 mounted to a satellite side 280 at an outlet opening 282. In some embodiments, the satellite arm assembly 285 may comprise a plurality of nozzles configured to spray jets of washing fluid onto dishware within the dishwasher. For example, the satellite arm assembly 285 may be similar to the second wash arm described in Intl. Appl. No. PCT/EP2016/066289, filed Jul. 8, 2016, the contents of which are hereby incorporated by reference in their entirety. The driving side 205 and satellite side 280 may share a common axis 27 along a length of spray arm 21, described hereinafter with reference to FIGS. 2-6. As depicted, the driving side 205 and the satellite side 280 extend, generally in opposite directions from the inlet opening 290. Although illustrated herein with reference to a spray arm assembly 20 which includes a satellite arm assembly 285 mounted to the spray arm 21, the present disclosure contemplates, in some embodiments, that the spray arm 21 may not include a satellite arm assembly 285, and may use one or more nozzles at or near the position of the outlet opening 282.

In the example embodiment of FIG. 2, a spray detergent nozzle 210 is disposed on the driving side 205 of the spray arm 21. In some embodiments, the torque imparted to the spray arm 21 by the fan-shaped jet of water produced by the spray detergent nozzle 210 may cause the spray arm 21 to rotate about the mounting point at the inlet opening 290 (e.g., via lock nut 305 in FIG. 2). The rotation of the spray arm 21 may be within/on a plane that is substantially horizontal (e.g., perpendicular to the vertical, height changing positions and axis of rotation 24), described further with reference to FIGS. 3A-5 below.

Figure 3A:
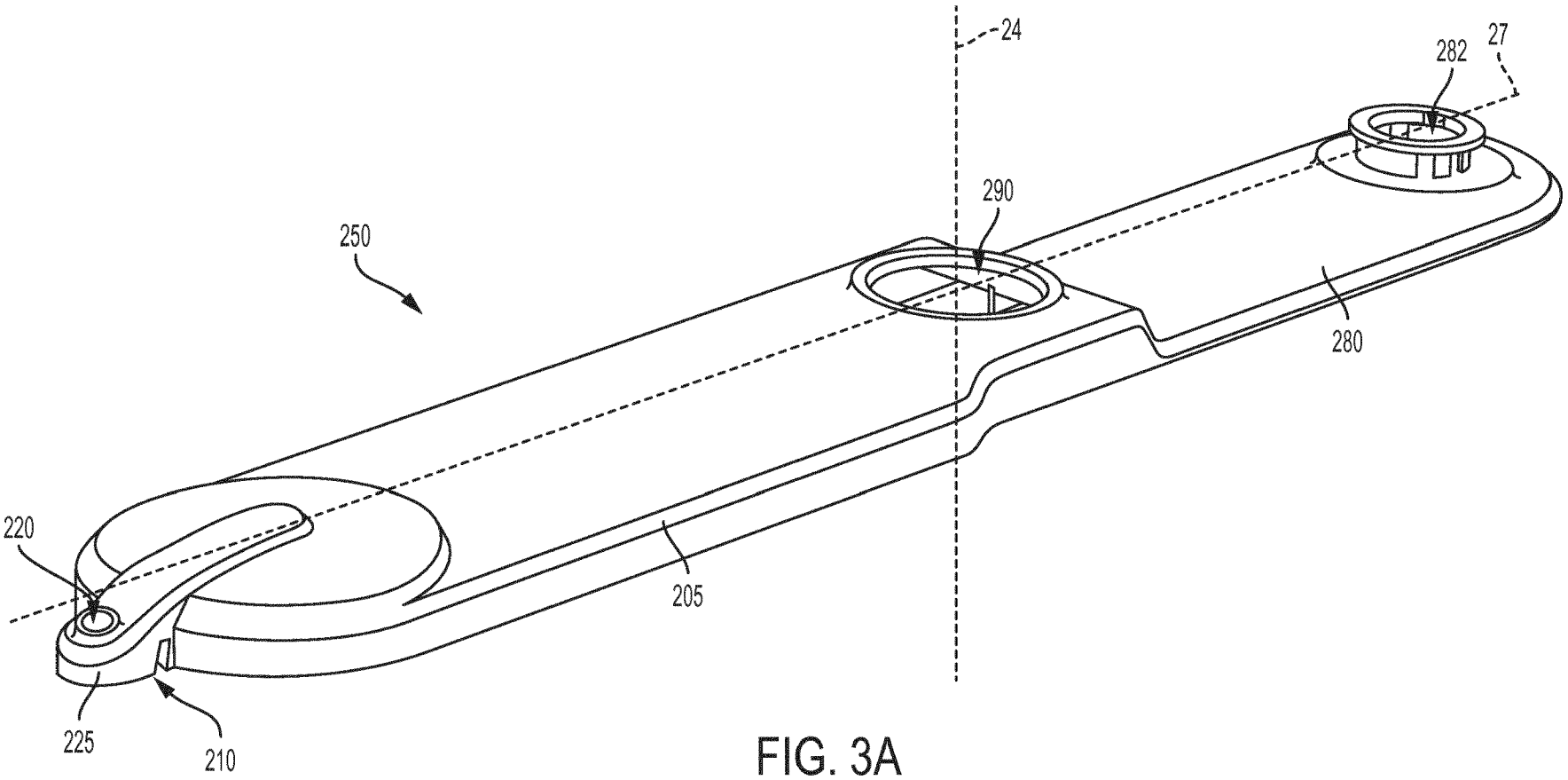
FIG. 3A illustrates a top perspective view of a top shell of the spray arm of FIG. 2.

In an example embodiment, as shown in FIGS. 3A-5, body 257 of the spray arm 21 includes a top shell 250 and a bottom shell 255. In some embodiments, the top shell 250 and the bottom shell 255 may be molded and/or otherwise manufactured separately and then joined together to form the spray arm 21. In some other embodiments, the spray arm 21 may be manufactured as one piece or many pieces that may be similar in structure to the structure of the top shell 250 and bottom shell 255 of the body 257 once they are joined together. As described below, FIGS. 3A and 3B illustrate top and bottom perspective views, respectively, of an example top shell 250 and FIGS. 4A and 4B illustrate bottom and top perspective views, respectively, of an example bottom shell 255. While described hereinafter with reference to two separate, molded pieces (e.g., top shell 250 and bottom shell 255) joined together to form the body 257 of the spray arm 21, the present disclosure contemplates that the body 257 of the spray arm 21 may equally be formed as a single, integral piece (e.g., via injection molding, extrusion, or the like), or greater than two pieces.

Figure 3B:
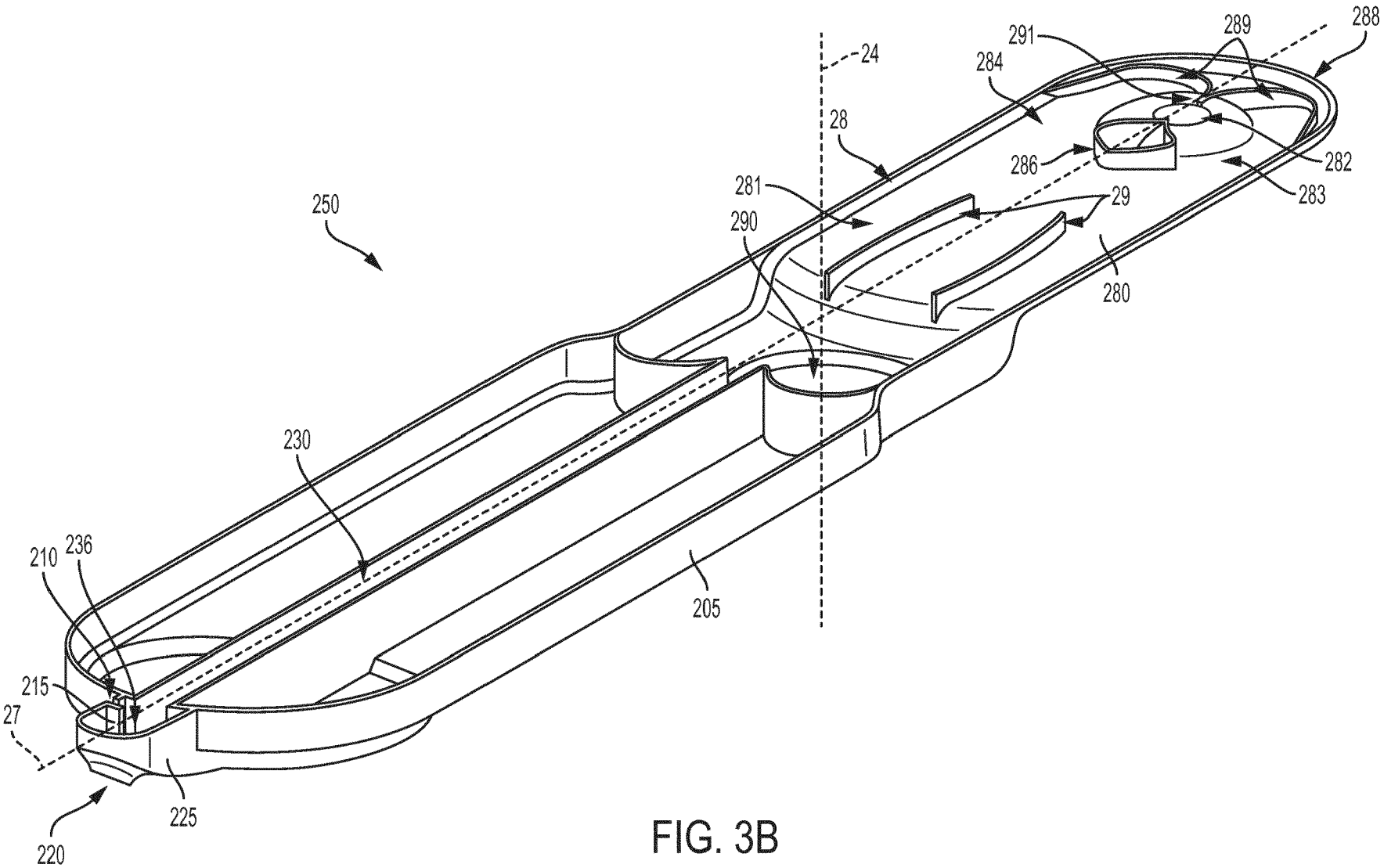
FIG. 3B illustrates a bottom perspective view of the top shell of the spray arm of FIG. 3A.
Figure 4A:
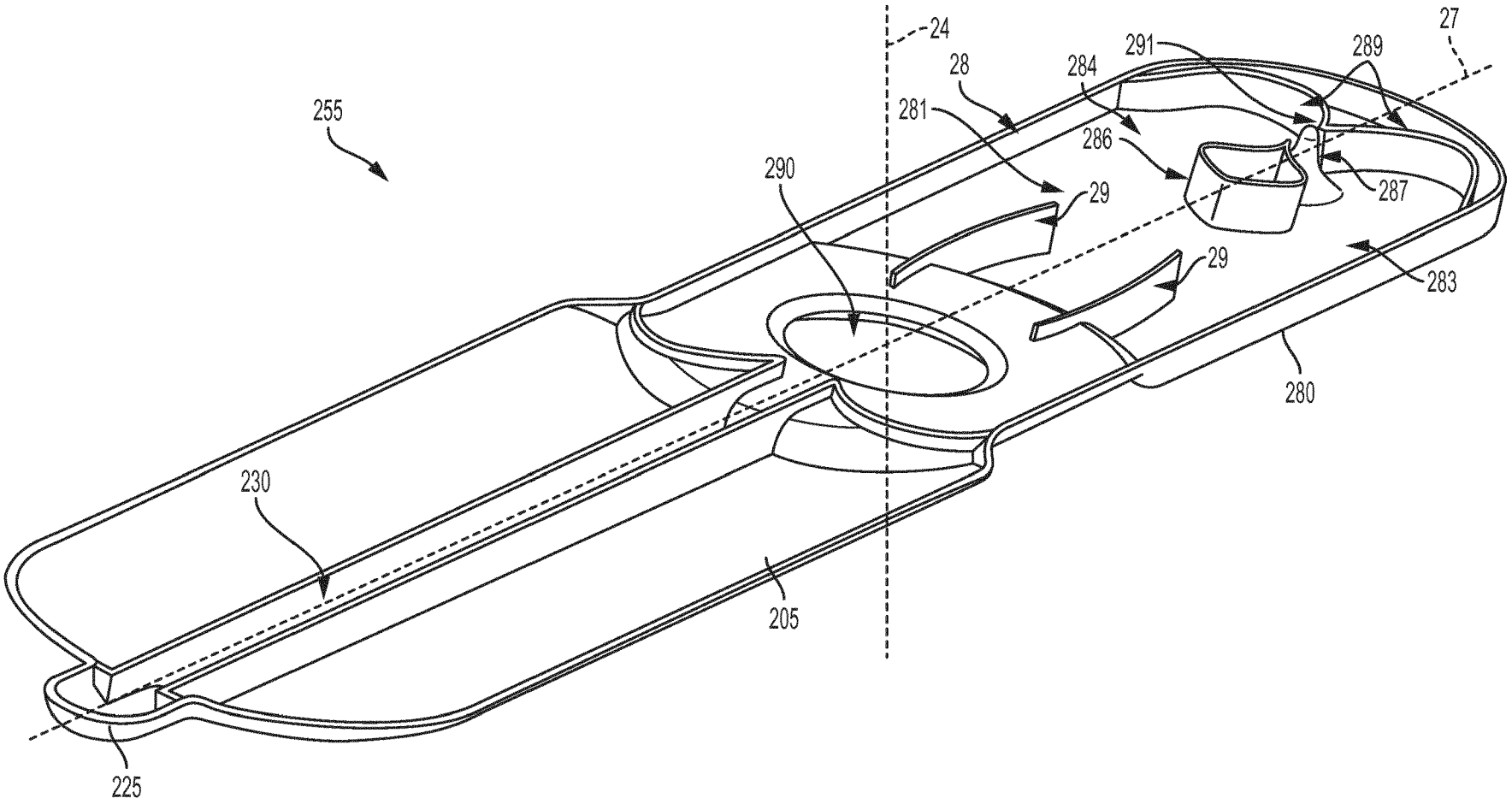
FIG. 4A illustrates a top perspective view of a bottom shell of the spray arm of FIG. 2.
Figure 4B:
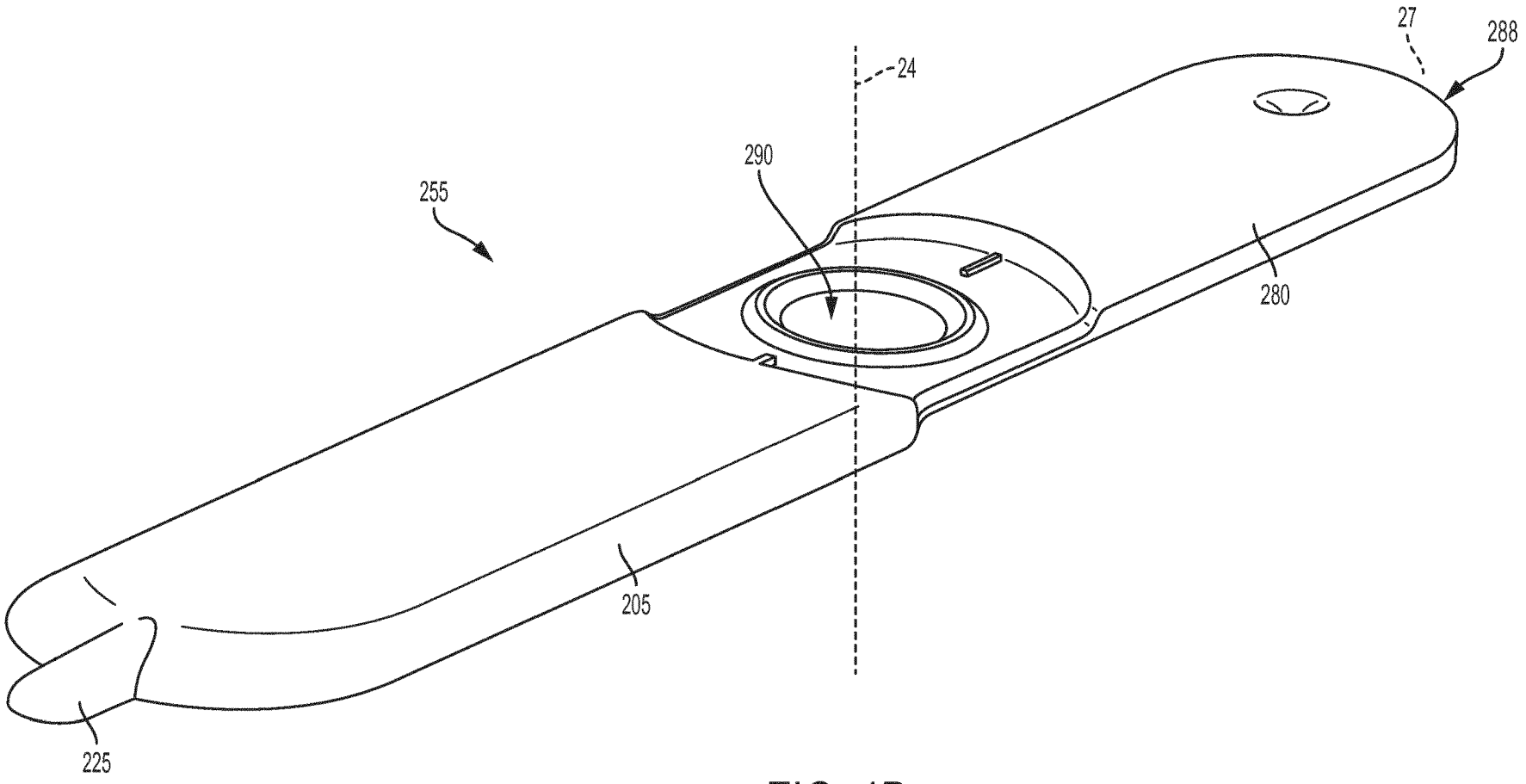
FIG. 4B illustrates a bottom perspective view of the bottom shell of the spray arm of FIG. 4A.
Figure 5:
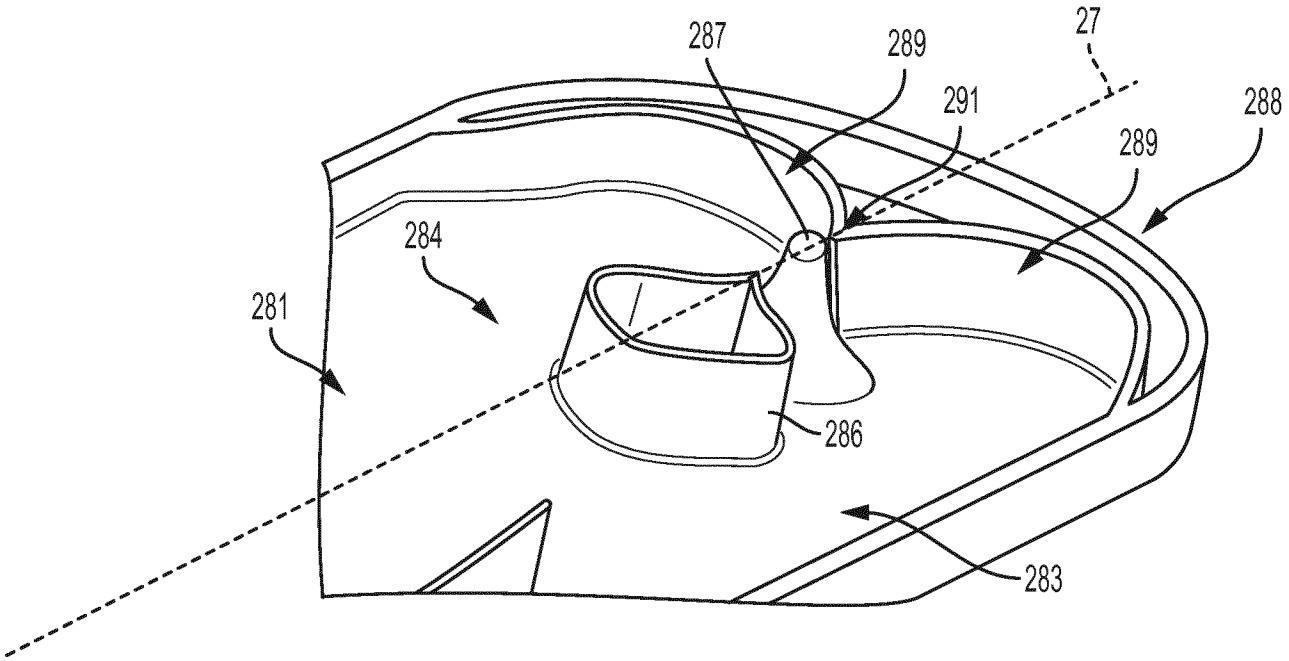
FIG. 5 illustrates a partial perspective view of the bottom shell of FIG. 4A.

In an example embodiment, as shown in FIGS. 3B and 4A, the spray arm 21 defines an inlet opening 290. As shown, the inlet opening 290 is positioned on an axis of rotation 24 of the spray arm 21, and the spray arm 21 is rotatable about the axis of rotation 24 via the connection between the spray arm 21 and the water conduit 300 (e.g., via the lock nut 305 in FIG. 2). Further, the water conduit 300 and the inlet opening 290 are in fluid communication such that washing fluid is directed from the water conduit 300 to the spray arm 21 via the inlet opening 290 and lock nut 305, which includes fluid communication from the water conduit 300 to the spray arm 21 through one or more seals, couplers, or the like that may be disposed within, at, or around the inlet opening 290. In the depicted embodiment, the inlet opening 290 is defined by the top shell 250 such that washing fluid enters the spray arm 21 from the water conduit 300 positioned above the inlet opening 290. As washing fluid is received by the inlet opening 290, said washing fluid is directed through the interior of the body (e.g., via various fluid supply channels described below) to the driving side 205 and the satellite side 280.

The driving side 205 includes a driving side fluid supply channel 230 configured to receive washing fluid from the water conduit 300 and supply and/or provide the washing fluid to the spray detergent nozzle 210 and/or the corner nozzle 220. By way of example, the spray detergent nozzle 210 and the corner nozzle 220 may, at least in part, share a common fluid supply channel.

In the embodiment shown in FIGS. 3B and 4A, the spray arm 21 further comprises a satellite side 280. The depicted satellite side 280 is located opposite the driving side 205 relative to the inlet opening 290, such that the inlet opening 290 may be located between the driving side 205 and the satellite side 280 at the pivot point of the spray arm 21. The satellite side 280 may define one or more fluid supply channels (e.g., supply channel 281 defining sub-fluid supply channels 283, 284) configured to receive washing fluid from the water conduit 300 and supply and/or provide the washing fluid to the satellite arm assembly 285 via an outlet opening 282. In the embodiment shown in FIGS. 3A-3B, the outlet opening 282 is located spaced along the body 257 of the satellite side 280 from the inlet opening 290. As illustrated, the inlet opening 290 and the outlet opening 282 may each be disposed on and/or defined at least in part by the top shell 250 of the body 257 (e.g., facing substantially the same direction from the spray arm 21). In some embodiments, the two openings may be defined on opposite halves of the body 257 depending on the desired spray direction from the outlet opening 282 (e.g., up, down, left, right, inward, outward, etc.) and the fluid supply direction into the inlet opening 290. In the depicted embodiment, the inlet opening may also extend through the bottom shell 255 so that the lock nut 305 extends entirely through the spray arm 21 and fluid is supplied to the spray arm through the opening 290 and lock nut 305. The satellite arm assembly 285 may be rotatably coupled with and attached to the outlet opening 282 as shown in FIG. 2, such that the outlet opening 282 is aligned with a central conduit of the satellite arm to supply washing fluid to the outlets 400, 405 (shown in FIG. 8) of the satellite arm.

Figure 7:
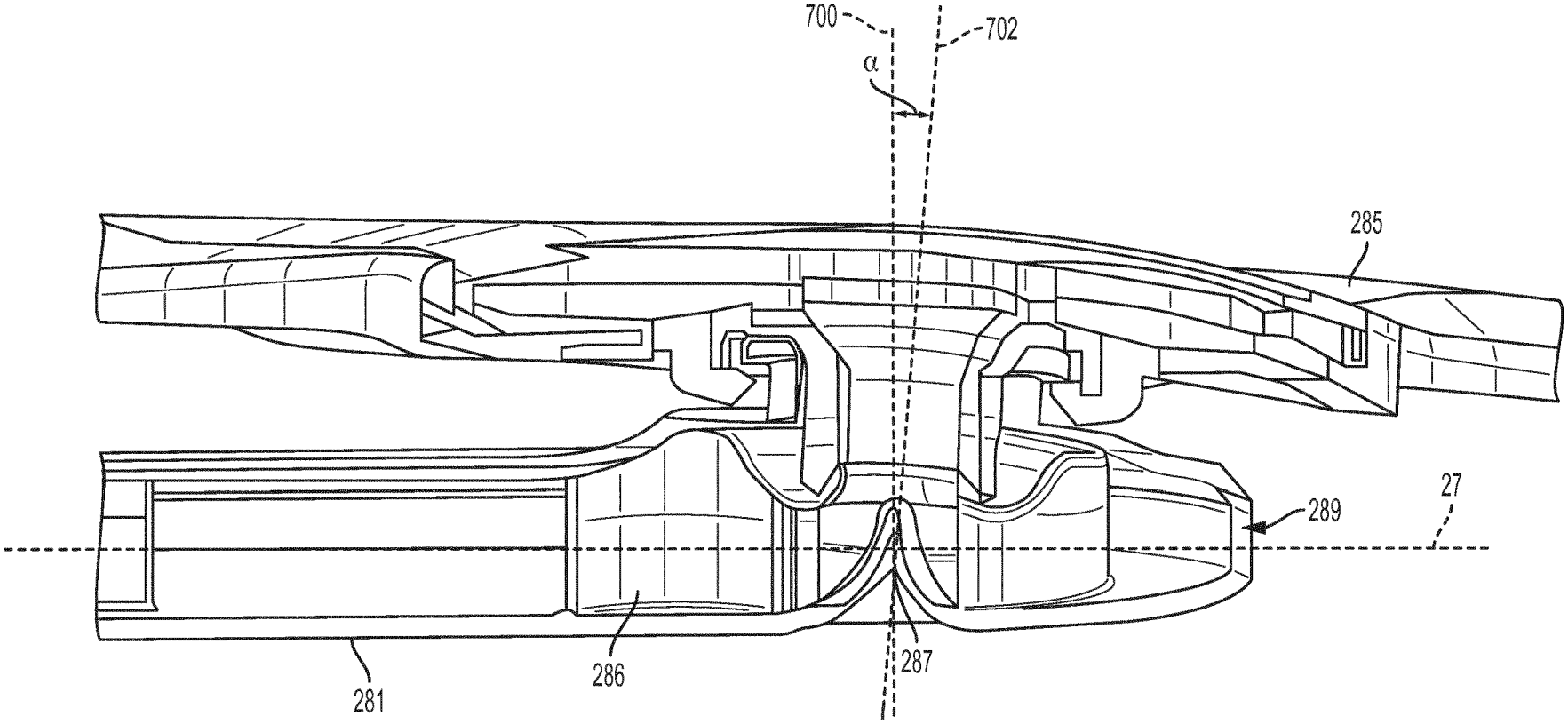
FIG. 7 illustrates a side cut-away view of a spray arm assembly with a spray arm and a satellite arm assembly, in accordance with an example embodiment.

In the depicted example embodiment, an axis 27 extends between the inlet opening 290 and the outlet opening 282 located substantially along a lateral midline of the spray arm 21. While both the inlet opening 290 and the outlet opening 282 are located on the top shell 250 in FIG. 3A, in some embodiments, each opening may also be located in separate planes of differing vertical heights relative to the axis of rotation 24 of the spray arm 21. The plane of inlet opening 290 may be substantially parallel with respect to the outlet opening 282 or may be oriented at a different angle (e.g., angled radially outwardly as shown in FIG. 7). As discussed herein, "height" is given in reference to the vertical elevation relative to the dishwasher 10 when placed in an operating position, as shown in FIG. 1, and parallel to the axis of rotation 24 in the depicted embodiment. As is evident by the embodiment illustrated in FIGS. 1 and 2, the vertical locations of said openings may be arranged such that a satellite arm assembly 285 may be accommodated above the satellite portion 280 of the spray arm 21, beneath the dish rack 30, 35. In an example embodiment (not shown) that does not have a satellite arm assembly 285, the one or more fluid channels 281, 283, 284 described below may be configured to supply and/or provide the washing fluid to a plurality of nozzles disposed on the satellite side 280. In any of the embodiments described herein, the satellite side (e.g., satellite side 280 in FIGS. 2-4B) and the driving side (e.g., driving side 205 in FIGS. 2-4B) may either or both include narrowing fluid channels (e.g., fluid supply channel 230 in FIG. 4A) or one or more fluid channels (e.g., fluid channels 281, 283, 284 in FIG. 4A described below) and curved inner surface (e.g., two concave semi-circular walls 289 in FIG. 4A described below).

With continued reference to the embodiment shown in FIGS. 3B and 4A, the depicted satellite side 280 of the spray arm 21 further includes a fluid supply channel 281. As shown, the fluid supply channel 281 extends between and fluidly communicates the inlet opening 290 and the outlet opening 282 within the body 257 of the spray arm 21. As illustrated in FIGS. 3B and 4A, the fluid supply channel 281 is defined and bounded by an inner wall 28 of the satellite side 280 of the spray arm 21 and may include the space enclosed by the satellite side 280 of the spray arm 21. In particular, the fluid supply channel 281 may include the surfaces bounding the space within the spray arm 21 including the inner wall 28 of the satellite side extending from at least the inlet opening 290 to an end of the spray arm 21 radially past the outlet opening 282 with respect to the axis 27. As discussed herein, the fluid supply channel 281 may be sub-divided into two or more channels (e.g., channels 283, 284) at various points along its length depending upon the internal flow-directing structures of the spray arm.

In the embodiment of FIGS. 3B and 4A, the body 257 also defines two vertical vanes 29 which are located along a length of the body 257 of the spray arm 21, with a longitudinal dimension extending in the direction of fluid flow to stabilize the fluid flow and support the structure of the spray arm. As shown, the two vertical vanes 29 extend from the top shell 250 to the bottom shell 255 to serve as walls within the body 257 of the spray arm 21 and separate at least a portion of the fluid supply channel 281. In the depicted embodiment, the two vertical vanes 29 of the satellite side 280 serve to create three separate areas of the fluid supply channel 281. In some embodiments, the body 257 may not include vertical vanes, walls, or other structural separations. Similarly, in some embodiments, the body 257 may include any number of structures (e.g., vertical vanes, horizontal walls, columns, pillars, or the like) in any orientation.

In an example embodiment, as shown in FIGS. 3B, 4A, and 5-6, the satellite side 280 of the spray arm 21 defines a flow-directing element 286 disposed between the inlet opening 290 and the outlet opening 282 configured to separate the fluid flow within the body 257. In the depicted embodiment, the flow directing element 286 is located along the axis 27 between the inlet opening 290 and the outlet opening 282 and is adjacent to the outlet opening 282. In the depicted embodiment, flow directing element 286 is a flow separating structure (e.g., pillar, column, or the like) that extends from the top shell 250 to the bottom shell 255 to separate the fluid supply channel 281 into two outer fluid supply channels 283, 284. The flow directing element 286 is configured such that at least a portion of the washing fluid within the fluid supply channel 281 is separated into each of the outer fluid supply channels 283, 284. In particular, washing fluid may flow radially outward with respect to the spray arm 21 (e.g., generally along or parallel to the axis 27) from the inlet opening 290 to the outlet opening 282 via the fluid supply channel 281. The fluid in the fluid supply channel 281 may flow toward and around the flow directing element 286 such that at least a portion of this washing fluid impinges upon radially inward end of the flow directing element 286, with respect to axis 27, and is directed into one of the outer fluid supply channels 283, 284. After passing the widest portion of the flow directing element 286 the fluid in the channels 281, 283, 284 may then move laterally inward (e.g., a component of the flow may move towards the midline of the spray arm, perpendicular to the axis 27). In some embodiments, the flow directing element 286 may be a diamond or kite shape.

In the embodiment of FIGS. 3B, 4A, and 5-6, the flow directing element 286 extending from the top shell 250 to the bottom shell 255 has a blunt radially inward end (e.g., the leading edge facing the washing fluid flowing from the inlet opening 290), a sharp, tapered tail at radially outward end (e.g., the trailing edge located immediately adjacent the outlet opening 282), and is shaped substantially like a tear drop in the horizontal plane (e.g., the cross-section of the flow directing element 286 in the plane of rotation of the spray arm 21 may be substantially diamond, kite, or tear-drop shaped). Additionally, the flow directing element 286, in an example embodiment as shown in FIGS. 3B, 4A, and 5-6, is located along the axis 27 extending between the inlet opening 290 and the outlet opening 282 and is further disposed along a longitudinal (e.g., along or parallel to the axis 27) midline of the spray arm 21 (e.g., symmetric along the middle of the fluid supply channel 281). In some embodiments, the flow directing element 286 may be any other shape (e.g., circle, square, rhombus, triangle, or the like) at any position in the horizontal plane so as to divide the fluid supply channel 281 into two fluid supply channels (e.g., into the outer fluid supply channels 283, 284).

Additionally, at least a portion of the outer fluid supply channels 283, 284 of the fluid supply channel 281 may extend radially past the outlet opening 282 relative the inlet opening 290 and a portion of the flow may be turned back towards the inlet opening 290 to supply fluid to the outlet opening 282 from all sides. In the depicted embodiment, this portion is configured such that the outer fluid supply channels 283, 284 are configured to direct the washing fluid flowing from the inlet opening 290 to the outlet opening 282 radially past the outlet opening 282 and at least partially back towards the inlet opening 290 before entering the outlet opening 282. Said differently, washing fluid flowing through the body 257, generally in line or parallel with the axis 27 and extending from the inlet opening 290 to the outlet opening 282, may be directed by the outer fluid supply channels 283, 284 of the fluid supply channel 281 past the outlet opening 282 relative to the axis 27 where a portion of the outer fluid supply channels 283, 284 defined by an inner wall 28 of the satellite side 280 of the body 257 of the spray arm 21 redirects the washing fluid radially and laterally inward. In such embodiments, a radial component of the washing fluid flows at least partially back toward the inlet opening 290 while a lateral component of the fluid flow also moves inwardly perpendicular with respect to the axis 27.

Figure 6:
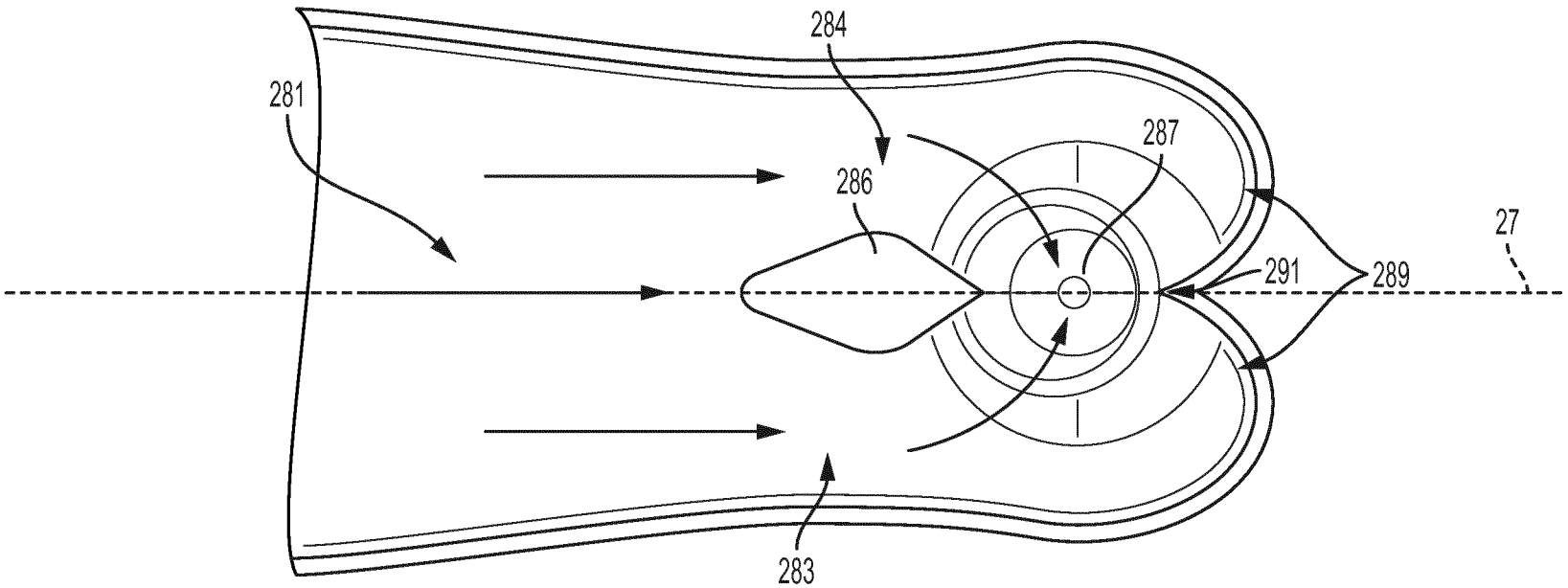
FIG. 6 illustrates a partial top view of the bottom shell of the spray arm shown in FIG. 4A with fluid flow arrows and without an exterior wall.

In the example embodiment of FIGS. 3B, 4A, and 6, the inner wall 28 of the body 257 defines a curved inner surface that may include two concave semi-circular walls 289 located at a distal end of the spray arm 21 radially past (e.g., outward of) the outlet opening 282 relative the inlet opening 290, which two concave semi-circular walls 289 define the portion of the outer fluid supply channels 283, 284 that extend past the outlet opening 282. In the depicted embodiment, the two concave semi-circular walls 289 are positioned so as to form a convergence point 291 between the two semi-circular walls 289 producing a heart-like shape. Said differently, the concave semi-circular walls 289 may smoothly transition the inner wall 28 from its laterally outermost portion, oriented substantially parallel to the axis 27 to its convergence point 291 oriented towards a fluid control member 287 and outlet opening 282 on the opposite side of the fluid control member 287, the outlet opening 282, and the flow directing element 286 from the opening 290. As shown in the depicted embodiment, the convergence point 291 is located substantially along the axis 27 extending between the inlet opening 290 and the outlet opening 282 and further is disposed at least partially beneath the outlet opening 282. As used herein, the "two concave semi-circular walls 289" include both a single wall with two semi-circular portions and two separate walls connected at an intermediate point (e.g., at convergence point 291).

In some embodiments, the outer fluid supply channels 283, 284 defined by the inner wall 28 may begin curving laterally outward with respect to the axis 27 at a point radially inward of the outlet opening 282. In some embodiments (e.g., as shown in FIG. 6), the inner wall 28 may be defined such that the outer fluid supply channels 283, 284 widen in the horizontal plane radially inward of the outlet opening 282 (e.g., upstream). In some embodiments as shown in FIGS. 3A-5, the body 257 defines an exterior wall 288. While illustrated in these embodiments of FIGS. 3A-5 as a single rounded exterior wall 288, the present disclosure contemplates that, in other embodiments, any number of walls (e.g., structures, partitions, or the like) may be defined by the body 257 to form the concave semi-circular walls 289, fluid control member 287, and/or flow-directing element 286 as described above. With reference to FIGS. 3B, 4A, and 5-6, the depicted outer fluid supply channels 283, 284 are located along opposing sides of the outlet opening 282 and are configured to direct the washing fluid toward to the outlet opening 282, either directly past the flow directing element 286 or using the surfaces 289.

In some embodiments, the semi-circular walls 289 are configured to redirect the washing fluid up to 180° from an initial direction (e.g., reversing the direction of the washing fluid completely back towards both the inlet opening 290 and outlet opening 282 in line with or parallel to the axis 27 that extends between the inlet opening 290 and the outlet opening 282). The initial direction may be defined as the fluid flow direction within the spray arm 21 before the flow encounters the flow controlling features described herein (e.g., the initial direction may be defined parallel with an axis (27) extending between the inlet opening (290) and the outlet opening (282) in a direction extending from the inlet opening (290) to the outlet opening (282)). In the example embodiment, washing fluid flowing from the inlet opening 290 to the outlet opening 282 radially past the outlet opening 282 is redirected greater than 90° with respect to the axis 27 extending between the inlet opening 290 and the outlet opening 282 by the semi-circular walls 288 and convergence point 291 (shown clearly in the flow diagram present in FIG. 8). This redirection of the washing fluid greater than 90° but less than or equal to 180° with respect to an axis 27 extending between the inlet opening 290 and the outlet opening 282 may be within the plane of rotation of the spray arm 21 (e.g., within a plane perpendicular to the axis of rotation 24 of the spray arm 21, which plane may include the axis 27 of the spray arm). In some embodiments, the redirection of the washing fluid may be approximately 165° with respect to an axis 27. In some embodiments, the redirection of the washing fluid may be approximately 140° to 170° with respect to an axis 27.

In the depicted embodiments, washing fluid entering into the satellite side 280 of the spray arm 21 is directed by the fluid supply channel 281 (e.g., the enclosed space of the inner wall 28) toward the flow directing element 286 and is separated by the flow directing element 286 extending between an interior surface of the top shell 250 (e.g., an upper interior surface of the body 257) and an interior surface of the bottom shell 255 (e.g., a lower interior surface of the body 257). The flow directing element 286 separates the washing fluid flow into the outer fluid supply channels 283, 284 (e.g., the space enclosed by the inner wall 28 radially outward of the flow directing element 286 with respect to axis 27). Some of the washing fluid directly enters the outlet opening 282, while some of the washing fluid is directed by the inner wall 28 of the outer fluid supply channels 283, 284 into the concave semi-circular walls 289 (e.g., the portion of the fluid supply channels 283, 284 that extends past the outlet opening 282). This washing fluid is redirected by the concave semi-circular walls 289 at least partially towards the inlet opening 290 before entering the outlet opening 282. The configuration of flow control features thereby allows a smooth, laminar flow of washing fluid to exit the outlet opening 282 from all sides, such that fluid travels smoothly and uniformly up the fluid control member 287 (described below) while minimizing shear flows hitting the protrusion inconsistently from different sides and disrupting the flow.

With reference to FIGS. 4A, 5, and 6-7, the satellite side 280 of the spray arm 21 may also define a fluid control member 287 disposed beneath the outlet opening 282 and configured to align washing fluid with the outlet opening 282. As shown in FIG. 7, the fluid control member 287 defines a protrusion that extends from an interior surface opposite the outlet opening 282 (e.g., in the depicted embodiment, from an interior, bottom surface of the body 257 on the bottom shell 255) toward the outlet opening 282. In the embodiment of FIG. 7, the fluid control member 287 may be positioned such that an angle $\alpha$ is created between an axis of the fluid control member 702 and a substantially vertical axis 700 (e.g., the fluid control member 287 leans outwardly with respect the vertical, at an angle to the axis of rotation 24). In some embodiments, the angle $\alpha$ between the vertical axis 700 and the control member axis 702 is approximately 4°. In the embodiments of FIGS. 4A, 5, and 6-7, the fluid control member 287 is shaped as a mountain-like protrusion with a wider based (e.g., attached to the bottom shell 255 of the spray arm 21) that tapers to a peak, which may be pointed or at least partially rounded.

During operation, some of the washing fluid entering into the concave semi-circular walls 289 (e.g., the portion of the fluid supply channels 283, 284 that extends past the outlet opening 282) of the body 257 is directed toward the outlet opening 282 as described above. In such an embodiment, the outlet opening 282 is also positioned along the control member axis 702 (e.g., at an angle $\alpha$ of 4° between the vertical axis 700 and the control member axis 702 is approximately 4° with respect to the vertical axis 700). The fluid control member 287 is configured such that at least some of the washing fluid entering the outlet opening 282 contacts the fluid control member 287 and is redirected from a substantially horizontal (e.g., within the plane of the spray arm 21) flow path to an at least partially vertical (e.g., along or parallel to the axis of rotation 24) flow path aligned by the fluid control member 287. This fluid control member 287 is configured to substantially align the washing fluid flow with a central conduit of the satellite arm 285 into a more uniform flow entering the outlet opening 282. In some embodiments, the fluid control member 287 may define an axis that is substantially coaxial with an axis of the central conduit of the satellite arm 285. Although described in reference to a mountain-like protrusion extending from the bottom shell 255, the present disclosure contemplates that any shape (e.g., conical, pyramid, or the like) in any orientation may be used so long as the fluid control member 287 may at least partially align the washing fluid.

In an example embodiment as shown in FIGS. 6-9, the body 257 may not include an exterior wall 288. In such an embodiment, the concave semi-circular walls 289 of the inner wall 28 may serve as the exterior wall of the body 257. Said differently, in some embodiments, the body 257 may have a heart shaped exterior. With continued reference to the embodiment of FIGS. 6-9, the inner wall 28 is positioned such that the outer fluid supply channels 283, 284 narrow by curving inwardly (e.g., toward the axis 27) adjacent the flow directing element 286. The inner wall 28 subsequently flares outwardly (e.g., away from the axis 27) such that the outer fluid supply channel 283, 283 widen. Still further, the inner wall (e.g., downstream of the flow directing element 286) forms the concave semi-circular walls 289 as described above. Said differently, the inner wall 28 along the length of the satellite side 280 narrows slightly prior to flaring outwardly to form the concave circular walls 289. The present disclosure contemplates that the inner wall 28 of the body 257 may have any variation in number of components, cross-section, shape, dimension, or the like along the axis 27 between the inlet opening 290 and the outlet opening 282 to accomplish the operation and flow paths described herein.

Figure 8:
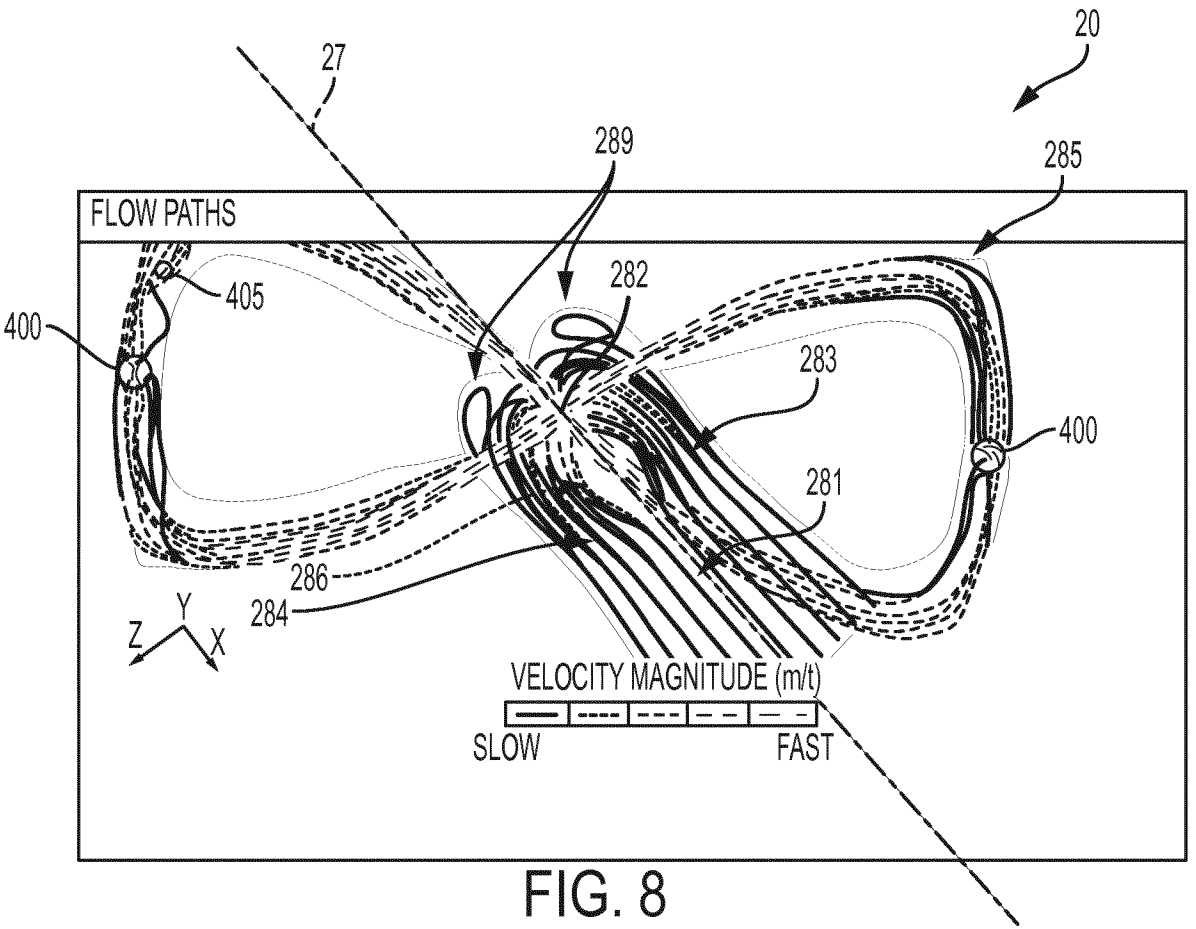
FIG. 8 illustrates a top view of a spray arm assembly with a spray arm and a satellite arm assembly showing fluid flow lines, in accordance with an example embodiment.
Figure 9:
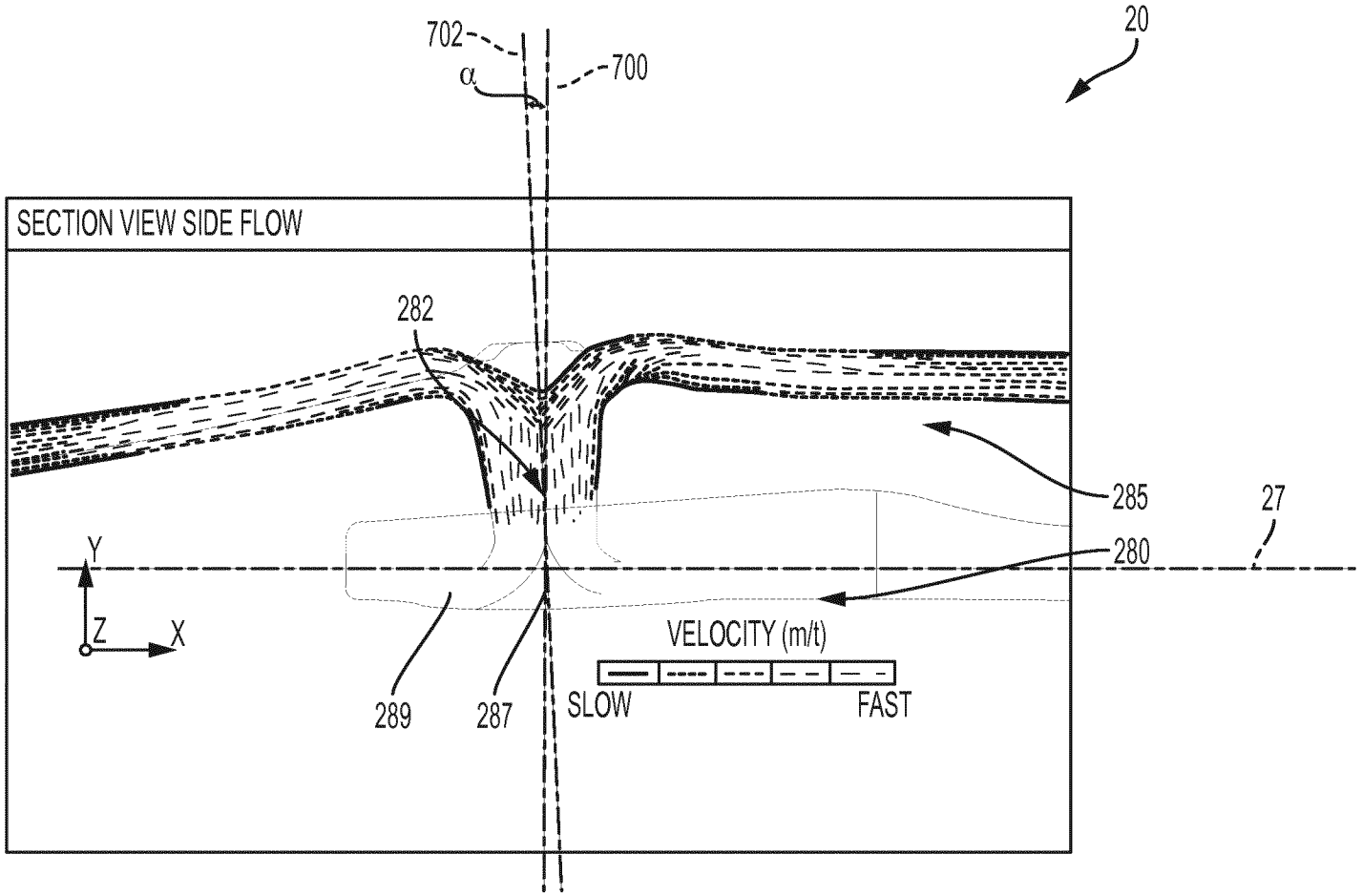
FIG. 9 illustrates a side view of the spray arm assembly and the fluid flow lines of FIG. 8.

With reference to FIGS. 8-9 a fluid flow simulation is illustrated for the spray arm assembly 20. As illustrated, the fluid flow (e.g. washing fluid received by the spray arm 21 via the inlet opening 290) is directed by the fluid supply channel 281 (e.g., defined by the inner wall 28). The fluid flow is then separated by the flow directing element 286 such that two outer fluid supply channels 283, 284 are defined from the fluid supply channel 281. Some of the fluid flow may then enter the outlet opening 282 directly and at least some of the fluid flow is also directed radially past the outlet opening 282 with respect to the axis 27 and turned back into a radially-outward side of the outlet opening 282 by the concave semi-circular walls 289 of the inner wall 28. The combination of inwardly-directed flow and outwardly-directed flow, the fluid control member 287, and the flow directing element 286 may align the fluid flow with the conduit of the satellite arm 285 to prevent turbulence and shear flows from disrupting the transition between spray arms. As illustrated in the embodiment of FIGS. 8-9, at least some of the fluid flow may recirculate (e.g., circle, impinge, or the like) within the portion of the fluid supply channels 283, 284 that extends past the outlet opening 282 (e.g., the concave semi-circular walls 289 defined by the inner wall 28). Additionally, as depicted, the fluid flow accelerates (e.g., increases in velocity) when entering the satellite arm assembly 285 at the outlet opening 282 below subsequently exiting the satellite arm assembly 285 at one or more exit nozzles 400. In some embodiments, with continued reference to FIG. 8, the satellite arm 285 may further include a drive nozzle 405 for causing rotation of the satellite arm.

Many modifications and other embodiments of the inventions set forth herein will come to mind to one skilled in the art to which these embodiments of the invention pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. While some drawings and description may omit features described elsewhere for simplicity of explanation, it is understood that these features may nonetheless be present in any of the embodiments in any combination or configuration, as detailed above. Although specific terms are employed herein, they are used in a generic and descriptive sense only and not for purposes of limitation.

The invention claimed is:

1. A spray arm assembly comprising:

a spray arm, the spray arm having a body defining:

an inlet opening and an outlet opening spaced from each other along the body, wherein the body is configured to receive washing fluid through the inlet opening and direct at least a portion of the washing fluid to the outlet opening, and one or more fluid supply channels extending between and fluidly communicating the inlet opening and the outlet opening within the body; and a satellite arm rotatably coupled to the spray arm at the outlet opening;

wherein at least a portion of the one or more fluid supply channels extends past the outlet opening relative to the inlet opening such that the one or more fluid supply channels are configured to direct at least a portion of washing fluid flowing from the inlet opening to the outlet opening radially past the outlet opening and at least partially back towards the inlet opening before entering the outlet opening and the satellite arm, and wherein the body further comprises a flow-directing element disposed between the inlet opening and the outlet opening, the flow-directing element dividing one of the one or more fluid supply channels into two fluid supply channels each located along opposing sides of flow-directing element to separate the washing fluid flowing through the spray arm.

2. The spray arm assembly according to claim 1, wherein the body of the spray arm further defines a curved inner surface located within the body at an end of the spray arm past the outlet opening relative the inlet opening, the curved inner surface corresponding the portion of the one or more fluid supply channels that extend past the outlet opening, such that the curved inner surface is configured to redirect the washing fluid at least partially back towards the inlet opening.

3. The spray arm assembly according to claim 2, wherein the curved inner surface of the body comprises two semi-circular walls.

4. The spray arm assembly according to claim 3, wherein the two semi-circular walls are positioned so as to form a convergence point between the two semi-circular walls, wherein the convergence point is located substantially along an axis extending between the inlet opening and the outlet opening.

5. The spray arm assembly according to claim 1, wherein the one or more fluid supply channels are configured to redirect washing fluid flowing from the inlet opening to the outlet opening radially past the outlet opening at an angle greater than 90° from an initial direction.

6. The spray arm assembly according to claim 5, wherein the initial direction is defined parallel with an axis extending between the inlet opening and the outlet opening in a direction extending from the inlet opening to the outlet opening.

7. The spray arm assembly according to claim 5, wherein the angle is greater than 90° and less than or equal to 180°.

8. The spray arm assembly according to claim 1, wherein the flow-directing element extends vertically from an interior bottom surface of the body to an interior top surface of the body.

9. The spray arm assembly according to claim 1, wherein the one or more fluid supply channels, including the two fluid supply channels, are configured to at least partially direct the separated washing fluid laterally inwardly towards an axis extending between the inlet opening and the outlet opening.

10. The spray arm assembly according to claim 1, wherein the flow-directing element is located along an axis extending between the inlet opening and the outlet opening adjacent the outlet opening.

11. The spray arm assembly according to claim 1, wherein the flow-directing element and the one or more fluid supply channels are configured such that such that at least a portion of the washing fluid converges at the outlet opening from all sides.

12. The spray arm assembly according to claim 1, wherein the body of the spray arm further defines a fluid control member disposed beneath the outlet opening configured to align washing fluid directed by the one or more fluid supply channels from the inlet opening to the outlet opening.

13. The spray arm assembly according to claim 12, wherein the fluid control member defines a protrusion that extends from an interior bottom surface of the body toward the outlet opening.

14. The spray arm assembly according to claim 13, wherein the protrusion of the fluid control member defines a longitudinal axis that is substantially coaxial with a longitudinal axis of a conduit of the satellite arm.

15. A dishwasher comprising a spray arm assembly, the spray arm assembly comprising:

a spray arm, the spray arm having a body defining:

an inlet opening and an outlet opening spaced from each other along the body, wherein the body is configured to receive washing fluid through the inlet opening and direct at least a portion of the washing fluid to the outlet opening, and one or more fluid supply channels extending between and fluidly communicating the inlet opening and the outlet opening within the body; and a satellite arm rotatably coupled to the spray arm at the outlet opening;

wherein at least a portion of the one or more fluid supply channels extends past the outlet opening relative to the inlet opening such that the one or more fluid supply channels are configured to direct at least a portion of washing fluid flowing from the inlet opening to the outlet opening radially past the outlet opening and at least partially back towards the inlet opening before entering the outlet opening and the satellite arm, and wherein the body further comprises a flow-directing element disposed between the inlet opening and the outlet opening, the flow-directing element dividing one of the one or more fluid supply channels into two fluid supply channels each located along opposing sides of flow-directing element to separate the washing fluid flowing through the spray arm.

* * * * *